US007588041B2

(12) United States Patent
Huang

(10) Patent No.: US 7,588,041 B2
(45) Date of Patent: Sep. 15, 2009

(54) CONTROL DEVICE FOR UMBRELLA

(76) Inventor: Lu Tsai Huang, No. 6, Avenue 8, Lane 41, Punan Street, Changhua (TW) 50093

( * ) Notice: Subject to any disclaimer, the term of this patent is extended or adjusted under 35 U.S.C. 154(b) by 66 days.

(21) Appl. No.: 12/070,694

(22) Filed: Feb. 20, 2008

(65) Prior Publication Data

US 2009/0205693 A1 Aug. 20, 2009

(51) Int. Cl.
*A45B 25/14* (2006.01)

(52) U.S. Cl. ..... 135/24; 135/28; 135/39

(58) Field of Classification Search ..... 135/15.1, 135/22, 24, 25.4, 28, 39
See application file for complete search history.

(56) References Cited

U.S. PATENT DOCUMENTS 2,725,066 A * 11/1955 Estes et al. ..... 135/15.1
4,934,394 A * 6/1990 Hermanson ..... 135/19.5
5,826,604 A * 10/1998 Hartmann ..... 135/27
6,082,383 A * 7/2000 Wilson ..... 135/41
6,216,712 B1 4/2001 Lin et al. ..... 135/31
6,247,483 B1 6/2001 Tung ..... 135/38
6,418,950 B1 7/2002 Tseng ..... 135/28
6,484,452 B2 * 11/2002 Yen ..... 52/24
7,210,491 B2 * 5/2007 Su ..... 135/28
7,225,821 B2 * 6/2007 Su ..... 135/38
7,484,518 B2 * 2/2009 Brader ..... 135/31

* cited by examiner

*Primary Examiner*—Winnie Yip
(74) *Attorney, Agent, or Firm*—Charles E. Baxley

(57) ABSTRACT

An umbrella includes a runner slidably engaged onto a central shaft for coupling to a whale bone device, a tubular member slidably engaged onto the central shaft and having an upper portion secured to the runner, a handle attached to the tubular member, and a controlling device for controlling the handle to move along the central shaft in order to fold the whale bone device either to the compact folding position or to the open working position and for allowing the umbrella to be effectively actuated or operated by the users. An anchor member is engaged into the central shaft and has a catch for anchoring the tubular member and the runner to the central shaft at different locations.

17 Claims, 5 Drawing Sheets

CONTROL DEVICE FOR UMBRELLA

BACKGROUND OF THE INVENTION

1. Field of the Invention

The present invention relates to an umbrella, and more particularly to an umbrella including a locking and releasing device or control device for suitably controlling the umbrella and for allowing the umbrella to be effectively actuated or operated by the users.

2. Description of the Prior Art

Typical umbrella facilities comprise a runner slidably engaged onto a central shaft for coupling to or for supporting the rib or stave assembly, and a spring-biased ball is disposed or engaged in the central shaft for selectively engaging with the runner and for temporarily or releasably securing the runner to the central shaft and thus for maintaining the rib or stave assembly and the canvas on an open working position.

For example, U.S. Pat. No. 6,216,712 to Lin et al. discloses one of the typical catch-free safety umbrella facilities comprising a stationary hub disposed on top of a central shaft, and a runner slidably engaged onto the central shaft for coupling to or for supporting the rib or stave assembly, and a ball resiliently held in the lower portion of the central shaft for selectively engaging with the runner and for stably retracting the rib or stave assembly and the canvas at a folded condition.

However, the spring-biased ball may be easily engaged with the runner and may also be easily disengaged from the runner such that the rib or stave assembly and the canvas may be opened or folded inadvertently.

U.S. Pat. No. 6,247,483 to Tung discloses another typical umbrella comprising an automatic locking and releasing device and also comprising a runner slidably engaged onto a central shaft for coupling or supporting a rib or stave assembly, and a pivot lever engaged in the central shaft, and a locking bar slidably engaged in the central shaft for being actuated to selectively engage with the runner and for controlling the rib or stave assembly and the canvas either at a folded condition or an open condition.

However, the locking bar and an extension block which is secured to the locking bar are extended out the central shaft and may be actuated or operated by the users or the other objects inadvertently.

U.S. Pat. No. 6,418,950 to Tseng discloses a further typical umbrella also comprising a runner slidably engaged onto a central tube for coupling or supporting a whale bone device, and two catches slidably engaged in the central tube and biased or forced to moved out of the central tube to selectively engage with the runner and to control the whale bone device and the canvas either at a folded condition or an open condition, and a latch slidably engaged in the runner to selectively engage with the catches.

However, similarly, the knob of the latch will also be biased to move out of the runner and may thus be actuated or operated by the users or the other objects inadvertently.

The present invention has arisen to mitigate and/or obviate the afore-described disadvantages of the conventional umbrella facilities.

SUMMARY OF THE INVENTION

The primary objective of the present invention is to provide an umbrella including a locking and releasing device or control device for suitably controlling the umbrella and for allowing the umbrella to be effectively actuated or operated by the users.

In accordance with one aspect of the invention, there is provided an umbrella comprising a central shaft including a stationary hub disposed on an upper portion of the central shaft, and including a hand grip attached to a lower portion of the central shaft for being held by a user, a runner slidably engaged onto the central shaft for coupling to a whale bone device, a tubular member slidably engaged onto the central shaft for moving up and down along the central shaft, and including a lower portion, and including an upper portion secured to the runner for allowing the tubular member to be moved in concert with the runner, the runner being movable toward the stationary hub for allowing the whale bone device to be folded to a compact folding position, and the runner being movable away from the stationary hub for allowing the whale bone device to be opened to an open working position, a handle attached to the lower portion of the tubular member for allowing the tubular member and the runner to be moved up and down along the central shaft with the handle, and a controlling device for controlling the handle to move along the central shaft in order to selectively fold the whale bone device to the compact folding position or to open the whale bone device to the open working position.

The tubular member includes a first anchor orifice and a second anchor orifice formed in the tubular member, and the central shaft includes an anchor member engaged into the central shaft and having a catch extended out of the central shaft for selectively engaging into either of the first or the second anchor orifices of the tubular member and for anchoring the tubular member and the runner to the central shaft at different locations.

The central shaft includes an opening formed therein, the catch of the anchor member is extended out through the opening of the central shaft. The central shaft includes an aperture formed therein, and the anchor member includes an end portion engaged into the aperture of the central shaft for anchoring the anchor member to the central shaft.

A coupler is further provided and secured to the lower portion of the tubular member and moved in concert with the tubular member, and secured to the handle for securing to the handle to the lower portion of the tubular member.

The coupler includes at least one slot formed therein, and the tubular member includes at least one ear extended therefrom for engaging with the slot of the coupler and for securing the coupler to the tubular member. The coupler includes an inner thread formed therein, and the handle includes an outer thread for engaging with the inner thread of the coupler and for securing the handle to the coupler.

The tubular member includes at least one ear extended from the upper portion of the tubular member for engaging with the runner and for securing the runner to the tubular member. The tubular member includes at least one protrusion extended from the upper portion of the tubular member for engaging with the runner and for securing the runner to the tubular member.

The handle includes a chamber formed therein and includes a compartment formed in the handle and communicating with the chamber of the handle, and the controlling device includes a follower slidably engaged in the chamber of the handle, and includes a knob extended from the follower and slidably engaged through the tubular member and slidably engaged into the compartment of the handle for being selectively depressed by the user.

The handle includes a hub extended therefrom, and the compartment of the handle is formed in the hub of the handle. The handle includes a sleeve engaged onto an outer peripheral portion of the handle and flush with the hub of the handle.

The follower includes a space formed therein for slidably receiving the tubular member. The follower includes two flaps, and the space is formed between the flaps for slidably receiving the tubular member. A spring member is further provided and engaged with the follower for biasing the knob of the follower to engage into the compartment of the handle.

The controlling device includes a casing engaged into the chamber of the handle and anchored to the handle. The casing includes at least one ring member extended therefrom and having a hole formed in the ring member and aligned with a bore of the handle for receiving the tubular member and for anchoring the casing to the handle.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 2:
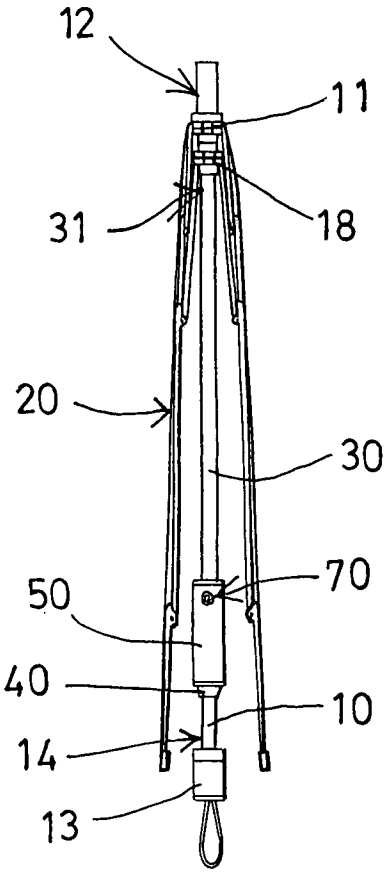
FIG. 2 is a plan schematic view similar to FIG. 1, illustrating the operation of the umbrella.
Figure 1:
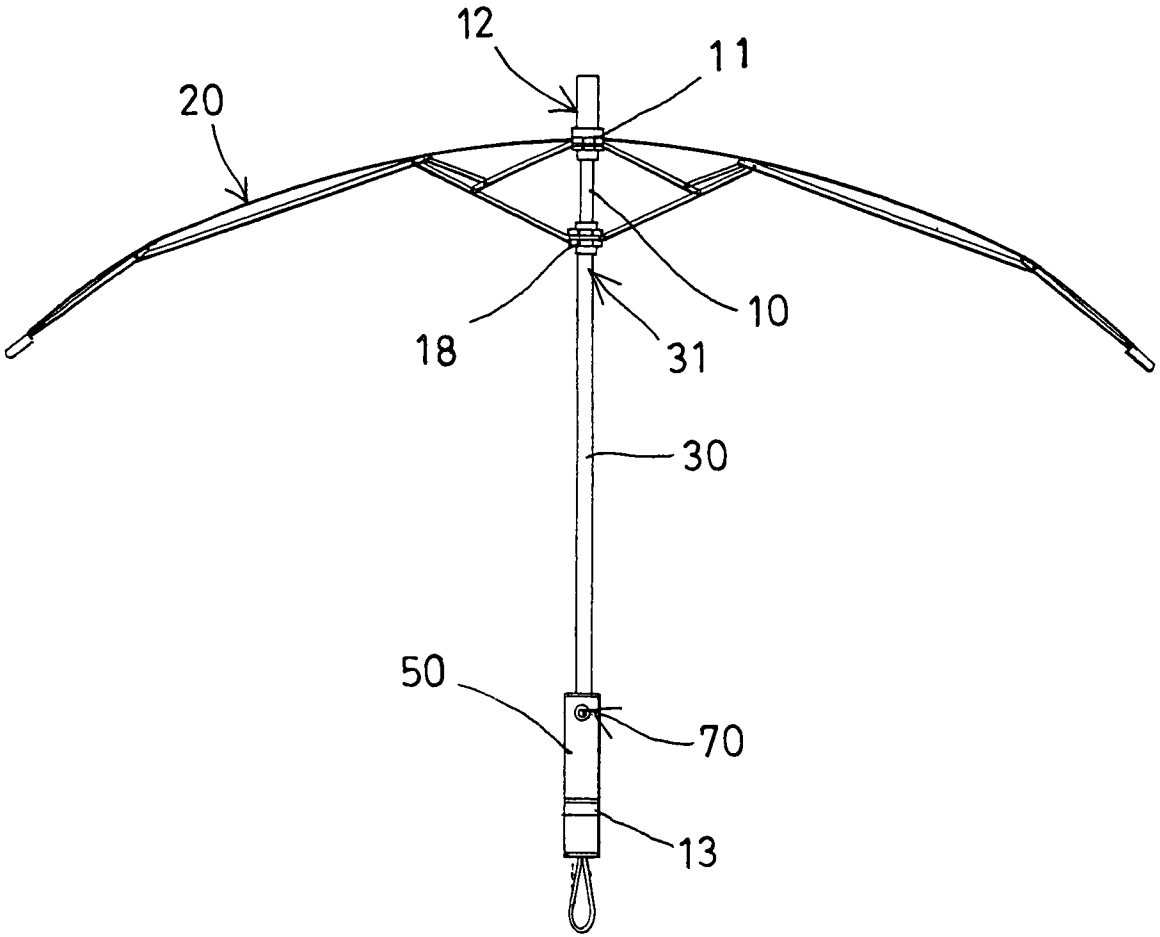
FIG. 1 is a plan schematic view of an umbrella in accordance with the present invention.
Figure 3:
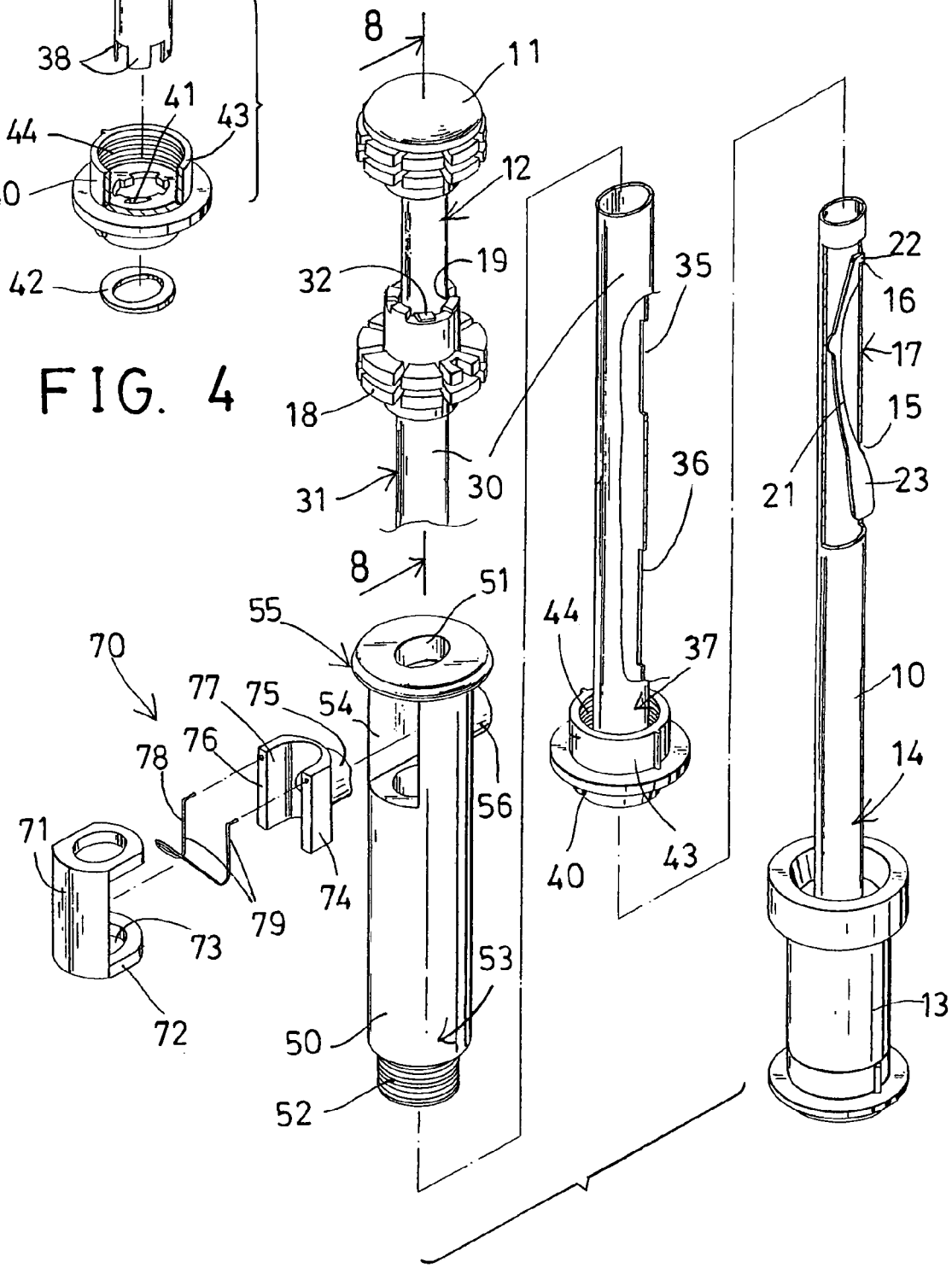
FIG. 3 is a partial exploded view of the umbrella.
Figure 5:
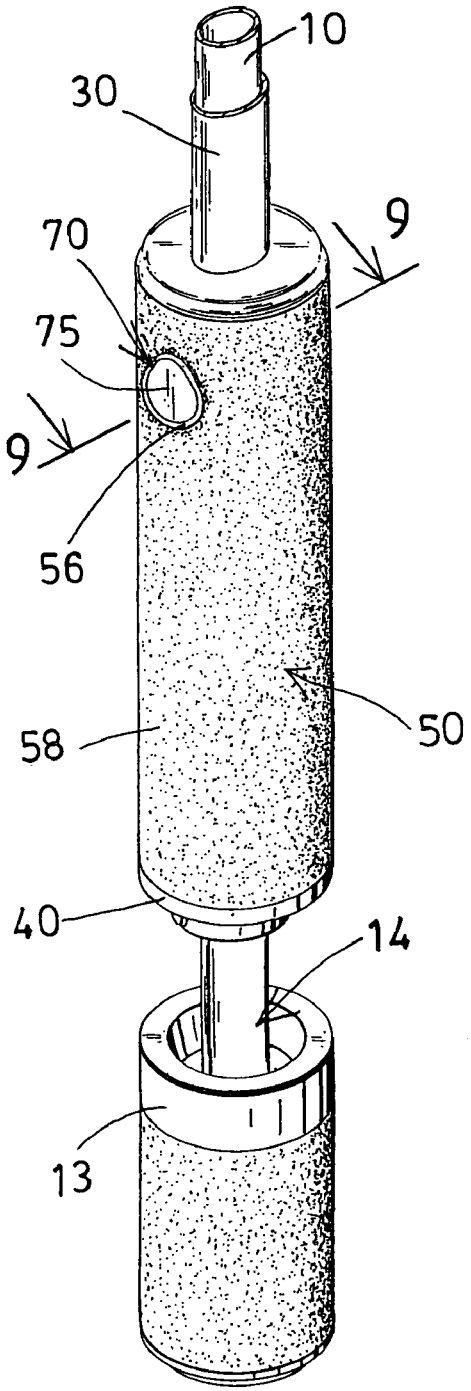
FIG. 5 is a partial perspective view of the umbrella.

Referring to the drawings, and initially to FIGS. 1-3, an umbrella in accordance with the present invention comprises a central shaft 10 including a stationary hub 11 disposed on top or the upper portion 12 of the central shaft 10, and including a hand grip 13 attached or secured to the lower portion 14 of the central shaft 10 for being grasped or held by the users, and including an opening 15 and an aperture 16 formed in the middle portion 17 or the lower portion 14 of the central shaft 10, and including a runner 18 having a bore 19 formed therein (FIG. 3) for slidably receiving the central shaft 10 and for slidably engaging onto the central shaft 10 and for coupling to or for supporting a rib or stave assembly or whale bone device 20, and the above-described structure is typical and will not be described in further details.

Figure 8:
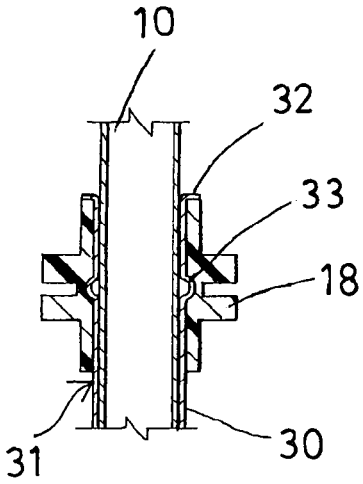
FIG. 8 is a partial cross sectional view of the umbrella taken along lines 8-8 of FIG. 3.
Figure 12:
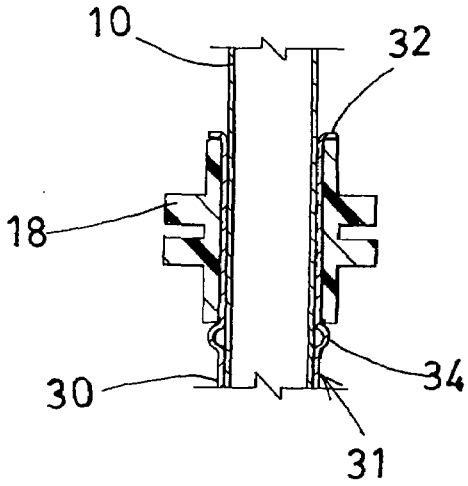
FIG. 12 is a still further partial cross sectional view similar to FIG. 8, illustrating the other arrangement of the umbrella.

A tubular member 30 is slidably engaged onto the central shaft 10 for moving up and down along the central shaft 10, and includes an upper portion 31 for coupling or securing to the runner 18 and for allowing the tubular member 30 to be moved in concert with the runner 18. For example, the tubular member 30 includes one or more folds or ears 32 bent or extended from the upper portion 31 thereof (FIGS. 3, 8, 12) for engaging with the runner 18 and for anchoring or securing the runner 18 to the tubular member 30, and further includes one or more protrusions 33 (FIG. 8), 34 (FIG. 12) extended laterally and outwardly from the upper portion 31 of the tubular member 30 for further engaging with the runner 18 and for further stably anchoring or securing the runner 18 to the tubular member 30.

Figure 6:
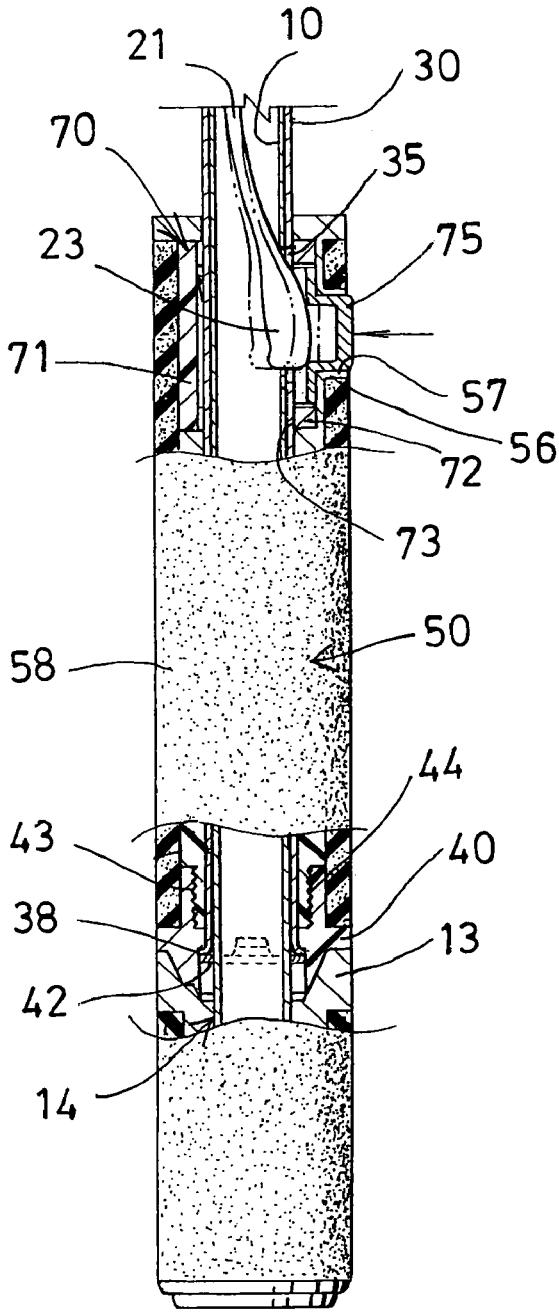
FIG. 6 is a partial plan schematic view of the umbrella, in which a portion of the umbrella has been cut off for showing the inner structure of the umbrella.
Figure 7:
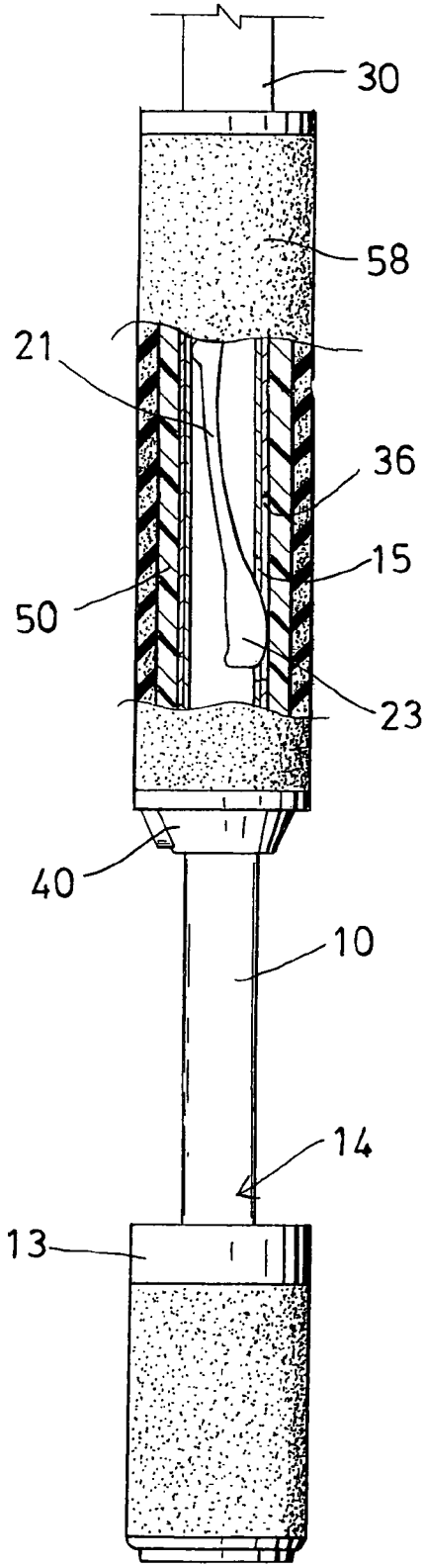
FIG. 7 is another partial plan schematic view similar to FIG. 6, in which a portion of the umbrella has been cut off for showing the inner structure of the umbrella.

As shown in FIGS. 3, 6-7, a spring anchor member 21 is engaged into the middle portion 17 or the lower portion 14 of the central shaft 10, and includes an upper end portion 22 (FIG. 3) engaged into the aperture 16 of the central shaft 10 for anchoring or securing the anchor member 21 to the central shaft 10, and includes a catch 23 extended or provided on the lower portion of the anchor member 21 and extendible out of the opening 15 of the central shaft 10. The tubular member 30 further includes two anchor orifices 35, 36 formed in the middle or lower portion 37 of the tubular member 30, and the catch 23 of the anchor member 21 is extendible or engageable into or through either of the anchor orifices 35, 36 of the tubular member 30 (FIGS. 6, 7) for anchoring or securing the tubular member 30 and the runner 18 to the central shaft 10 at different locations or positions.

Figure 4:
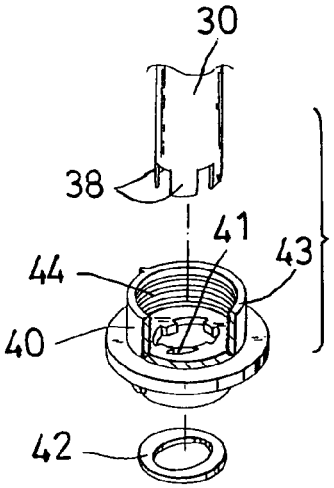
FIG. 4 is a further partial exploded view of the umbrella.

An end cap or coupler 40 is secured to the lower portion 37 of the tubular member 30 and moved in concert with the tubular member 30, and includes one or more slots 41 formed therein (FIG. 4), and the tubular member 30 includes one or more folds or ears 38 bent or extended from the lower portion 37 thereof (FIGS. 4, 6) for engaging with the slots 41 of the coupler 40 and for anchoring or securing the coupler 40 to the tubular member 30, and a washer or retaining ring 42 may further be provided and force-fitted or engaged into the lower portion of the coupler 40 for engaging with the folds or ears 38 of the tubular member 30 (FIG. 6) and for shielding and protecting the folds or ears 38 of the tubular member 30 and/or for preventing the folds or ears 38 of the tubular member 30 from being bent or disengaged from the coupler 40.

Figure 11:
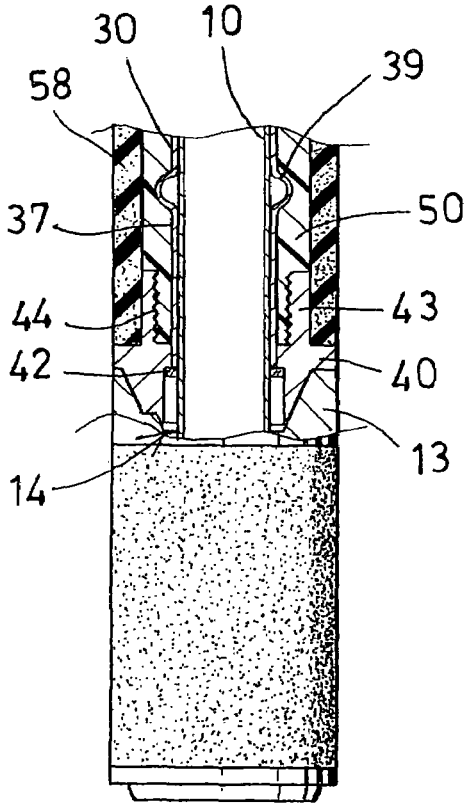
FIG. 11 is a further partial plan schematic view similar to FIG. 7, in which a portion of the umbrella has been cut off for showing the inner structure of the umbrella.

The coupler 40 further includes a tubular or cylindrical wall or member 43 extended upwardly therefrom (FIGS. 3, 4, 6, 11), and includes an inner thread 44 formed in the inner peripheral portion of the cylindrical member 43 for attaching or securing a handle 50 to the lower portion 37 of the tubular member 30 and for allowing the tubular member 30 and the runner 18 to be moved up and down along the central shaft 10 with or by the handle 50, best shown in FIGS. 1-2 and 5-7. As shown in FIG. 11, the tubular member 30 may further include one or more protrusions 39 extended laterally and outwardly from the lower portion 37 of the tubular member 30 for further securing to or engaging with the handle 50 and/or for further stably anchoring or securing or locking the handle 50 to the tubular member 30.

Figure 9:
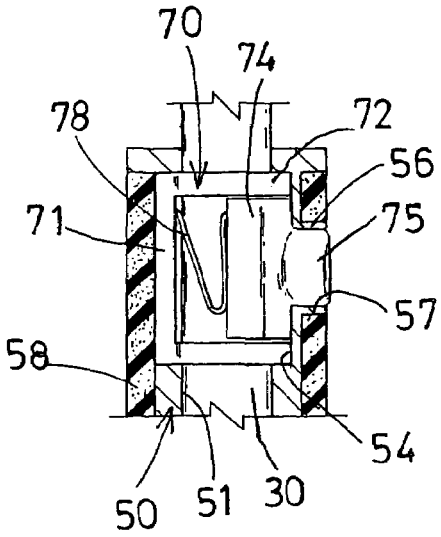
FIG. 9 is another partial cross sectional view of the umbrella taken along lines 9-9 of FIG. 5.

The handle 50 includes a bore 51 formed therein (FIG. 3) for receiving the tubular member 30 and for attaching or securing the handle 50 to the tubular member 30, and includes an outer thread 52 formed in the outer peripheral portion of the lower portion 53 of the handle 50 for threading or engaging with the inner thread 44 of the coupler 40 and for attaching or securing the handle 50 to the coupler 40 and the tubular member 30 and for allowing the handle 50 to be moved in concert with the coupler 40 and the tubular member 30 and the runner 18. The handle 50 further includes a chamber 54 formed in the upper portion 55 thereof (FIG. 3) for receiving a controlling means or device 70, and includes a stud or hub 56 extended laterally and outwardly from the upper portion 55 of the handle 50, and includes a compartment 57 formed in the hub 56 or in the handle 50 (FIGS. 6, 9, 10) and communicating with the chamber 54 of the handle 50.

The controlling means or device 70 includes a casing 71 engaged into the chamber 54 of the handle 50 and secured to the handle 50 and having two arms or ring members 72 extended laterally and outwardly therefrom (FIGS. 3, 9-10) and having a hole 73 formed in each of the ring members 72 and aligned with the bore 51 of the handle 50 for receiving the tubular member 30 and for attaching or securing the casing 71 to the handle 50 and the tubular member 30, and includes a follower 74 slidably received or engaged in the chamber 54 of the handle 50 and slidably disposed or engaged between the casing 71 and the hub 56 of the handle 50, and includes a knob 75 extended from the follower 74 for slidably engaging through one of the anchor orifices 35 of the tubular member 30 (FIG. 6), and for slidably receiving or engaging into the compartment 57 of the hub 56 of the handle 50 and for being selectively depressed or actuated by the users (FIG. 6).

It is preferable but not necessarily that the follower 74 includes two flaps 76 having a space 77 formed or defined between the flaps 76 (FIG. 3) for slidably receiving the tubular member 30 and for allowing the follower 74 to be moved toward or away from the tubular member 30 and for allowing the knob 75 of the follower 74 to be selectively depressed or actuated by the users (FIG. 6). A spring member 78 is disposed or engaged between the casing 71 and the follower 74, and includes two limbs 79 attached or secured or engaged with the flaps 76 of the follower 74 for being positioned or retained between the casing 71 and the follower 74 and for biasing the knob 75 of the follower 74 into the compartment 57 of the hub 56 of the handle 50. The handle 50 may include a soft or resilient outer covering or sleeve 58 engaged or molded onto the outer peripheral portion of the handle 50 and flush with the hub 56 of the handle 50 (FIGS. 6, 9-10) for being comfortably grasped or held by the users.

In operation, as shown in FIGS. 2, 6 and 7, when the handle 50 and the tubular member 30 and the runner 18 are moved away from the hand grip 13 and moved toward the stationary hub 11, the whale bone device 20 may be folded to a compact folding or receiving or storing position as shown in FIG. 2. At this moment, the tubular member 30 is moved relative to the central shaft 10, and the catch 23 of the anchor member 21 is engaged into or through the other anchor orifice 36 of the tubular member 30 (FIG. 7) for anchoring or securing or positioning the handle 50 and the tubular member 30 and the runner 18 to the central shaft 10 at the selected location or position and for maintaining or retaining the whale bone device 20 at the compact folding or receiving or storing position.

When it is required to open the whale bone device 20 to the unfolded or opening or working position as shown in FIG. 1, the handle 50 and the tubular member 30 and the runner 18 may be pulled or moved toward the hand grip 13 and moved away from the stationary hub 11, the catch 23 of the anchor member 21 may be selectively engaged through one of the anchor orifices 35 of the tubular member 30 (FIG. 6) and may be selectively engaged into the space 77 of the follower 74 for anchoring or securing or positioning the handle 50 and the tubular member 30 and the runner 18 to the central shaft 10 at the other selected location or position and for maintaining or retaining the whale bone device 20 at the unfolded or opening or working position.

Figure 10:
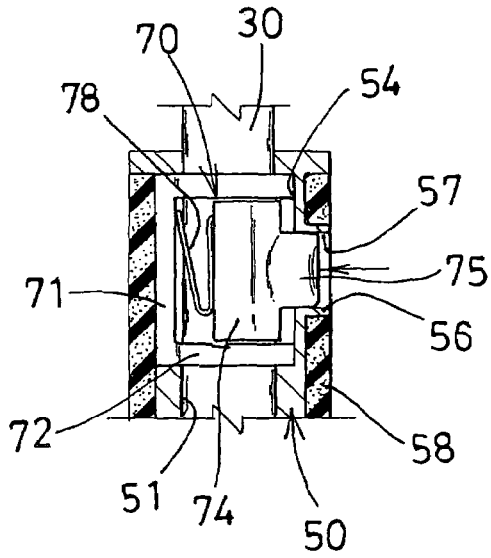
FIG. 10 is a further partial cross sectional view similar to FIG. 9, illustrating the operation of the umbrella.

When it is required to fold the whale bone device 20 to the compact folding or receiving or storing position, as shown in FIGS. 6 and 10, the knob 75 of the follower 74 may be depressed or actuated by the users onto the spring member 78 and may be depressed or forced into the compartment 57 of the hub 56 of the handle 50 in order to depress or force or disengage the catch 23 of the anchor member 21 from the anchor orifice 35 of the tubular member 30, and thus for allowing the handle 50 and the tubular member 30 and the runner 18 to be moved along the central shaft 10 and thus for allowing the whale bone device 20 to be folded to the compact folding or receiving or storing position again. The outwardly stretched or opened whale bone device 20 may apply a resilient force to the runner 18 and the tubular member 30 and the handle 50 when the catch 23 of the anchor member 21 is disengaged from the anchor orifice 35 of the tubular member 30.

It is to be noted that the provision and the engagement of the tubular member 30 onto the central shaft 10 may reinforce the central shaft 10, and the typical umbrella facilities failed to provide a tubular member 30 slidably engaged onto the central shaft 10 for reinforcing the central shaft 10, and failed to provide a handle 50 attached or secured to the tubular member 30 for moving the tubular member 30 and the runner 18 up and down along the central shaft 10, and failed to provide a controlling device 70 engaged into the handle 50 for controlling the movement between the tubular member 30 and the runner 18 and the central shaft 10. The provision and the engagement of the handle 50 to the tubular member 30 allow the tubular member 30 and the runner 18 to be easily moved up and down along the central shaft 10 with or by the handle 50. The handle 50 is located close to the hand grip 13 for being easily operated by the users.

Accordingly, the umbrella in accordance with the present invention includes a locking and releasing device or controlling device for suitably controlling the umbrella and for allowing the umbrella to be effectively actuated or operated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An umbrella comprising:

a central shaft including a stationary hub disposed on an upper portion of said central shaft, and including a hand grip attached to a lower portion of said central shaft for being held by a user, a runner slidably engaged onto said central shaft for coupling to a whale bone device, a tubular member slidably engaged onto said central shaft for moving up and down along said central shaft, and including a lower portion, and including an upper portion secured to said runner for allowing said tubular member to be moved in concert with said runner, said runner being movable toward said stationary hub for allowing said whale bone device to be folded to a compact folding position, and said runner being movable away from said stationary hub for allowing said whale bone device to be opened to an open working position, a handle attached to said lower portion of said tubular member for allowing said tubular member and said runner to be moved up and down along said central shaft with said handle, and means for controlling said handle to move along said central shaft in order to selectively fold said whale bone device to the compact folding position or to open said whale bone device to the open working position.

2. The umbrella as claimed in claim 1, wherein said tubular member includes a first anchor orifice and a second anchor orifice formed in said tubular member, and said central shaft includes an anchor member engaged into said central shaft and having a catch extended out of said central shaft for selectively engaging into either of said first or said second anchor orifices of said tubular member and for anchoring said tubular member and said runner to said central shaft at different locations.

3. The umbrella as claimed in claim 2, wherein said central shaft includes an opening formed therein, said catch of said anchor member is extended out through said opening of said central shaft.

4. The umbrella as claimed in claim 2, wherein said central shaft includes an aperture formed therein, and said anchor member includes an end portion engaged into said aperture of said central shaft for anchoring said anchor member to said central shaft.

5. The umbrella as claimed in claim 1, wherein a coupler is secured to said lower portion of said tubular member and moved in concert with said tubular member, and secured to said handle for securing to said handle to said lower portion of said tubular member.

6. The umbrella as claimed in claim 5, wherein said coupler includes at least one slot formed therein, and said tubular member includes at least one ear extended therefrom for engaging with said at least one slot of said coupler and for securing said coupler to said tubular member.

7. The umbrella as claimed in claim 5, wherein said coupler includes an inner thread formed therein, and said handle includes an outer thread for engaging with said inner thread of said coupler and for securing said handle to said coupler.

8. The umbrella as claimed in claim 1, wherein said tubular member includes at least one ear extended from said upper portion of said tubular member for engaging with said runner and for securing said runner to said tubular member.

9. The umbrella as claimed in claim 1, wherein said tubular member includes at least one protrusion extended from said upper portion of said tubular member for engaging with said runner and for securing said runner to said tubular member.

10. The umbrella as claimed in claim 1, wherein said handle includes a chamber formed therein and includes a compartment formed in said handle and communicating with said chamber of said handle, and said controlling means includes a follower slidably engaged in said chamber of said handle, and includes a knob extended from said follower and slidably engaged through said tubular member and slidably engaged into said compartment of said handle for being selectively depressed by the user.

11. The umbrella as claimed in claim 10, wherein said handle includes a hub extended therefrom, and said compartment of said handle is formed in said hub of said handle.

12. The umbrella as claimed in claim 11, wherein said handle includes a sleeve engaged onto an outer peripheral portion of said handle and flush with said hub of said handle.

13. The umbrella as claimed in claim 10, wherein said follower includes a space formed therein for slidably receiving said tubular member.

14. The umbrella as claimed in claim 13, wherein said follower includes two flaps, and said space is formed between said flaps for slidably receiving said tubular member.

15. The umbrella as claimed in claim 10, wherein a spring member is engaged with said follower for biasing said knob of said follower to engage into said compartment of said handle.

16. The umbrella as claimed in claim 10, wherein said controlling means includes a casing engaged into said chamber of said handle and anchored to said handle.

17. The umbrella as claimed in claim 16, wherein said casing includes at least one ring member extended therefrom and having a hole formed in said at least one ring member and aligned with a bore of said handle for receiving said tubular member and for anchoring said casing to said handle.

* * * * *